US005333871A

United States Patent [19]

Wishon

[11] Patent Number: 5,333,871

[45] Date of Patent: Aug. 2, 1994

[54] GOLF CLUB HEAD

[75] Inventor: Thomas W. Wishon, Newark, Ohio

[73] Assignee: Dynacraft Golf Products, Inc., Newark, Ohio

[21] Appl. No.: 831,853

[22] Filed: Feb. 5, 1992

[51] Int. Cl.[5] ..... A63B 53/04

[52] U.S. Cl. ..... 273/169; 273/DIG. 7; 273/DIG. 23; 273/DIG. 8; 273/172

[58] Field of Search ..... 273/167-175, 273/77 R, 77 A, 78, DIG. 7, DIG. 23, DIG. 8

[56] References Cited

U.S. PATENT DOCUMENTS

| | | | |
|---|---|---|---|
| 3,250,536 | 5/1966 | Moser . | |
| 3,390,881 | 7/1968 | Senne . | |
| 3,571,900 | 3/1971 | Hardesty . | |
| 3,843,122 | 10/1974 | Florian . | |
| 4,534,558 | 8/1985 | Yoneyama | 273/167 H X |
| 4,591,160 | 5/1986 | Piragino . | |
| 4,614,627 | 9/1986 | Curtis et al. . | |
| 4,690,408 | 9/1987 | Kobayashi | 273/174 X |
| 4,697,814 | 10/1987 | Yamada | 273/169 |
| 4,728,105 | 3/1988 | Kobayashi | 273/173 X |
| 4,793,616 | 12/1988 | Fernandez . | |
| 4,883,623 | 11/1989 | Nagamoto et al. . | |
| 4,991,843 | 2/1991 | Mori . | |
| 5,004,242 | 4/1991 | Iwanaga et al. | 273/169 |
| 5,009,425 | 10/1991 | Okumoto et al. | 273/167 H X |
| 5,078,397 | 1/1992 | Aizawa | 273/169 X |

FOREIGN PATENT DOCUMENTS

| | | |
|---|---|---|
| 692197 | 8/1964 | Canada . |
| 1190374 | 7/1989 | Japan . |

OTHER PUBLICATIONS

Ballingall, "Learn Golf In A Weekend," 1991, p. 3.

Askeland, Donald R., "The Science and Engineering of Materials", Copyright 1984 by Wadsworth, Inc., Belmont Calif., pp. 500-502.

*Primary Examiner*—V. Millin

*Assistant Examiner*—Sebastiano Passaniti

*Attorney, Agent, or Firm*—Schlemmer and Associates

[57] ABSTRACT

An ironhead comprising a relatively heavy, inner core member, preferably of metal, and a relatively lightweight, injection-molded outer member, preferably of thermoplastic elastomer, is disclosed. Preferred thermoplastic elastomer materials are glass filled urethanes and glass-filled polycarbonates. Alternative inner core designs are disclosed, both with and without a lateral support member for the striking face of the clubhead.

18 Claims, 3 Drawing Sheets

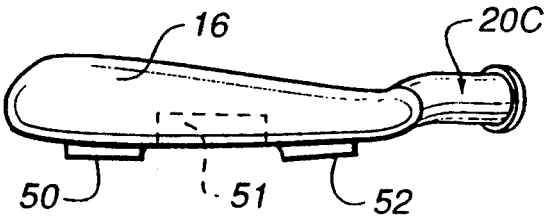
Fig. 7
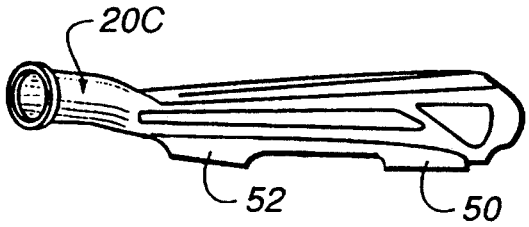
Fig. 8
Fig. 9
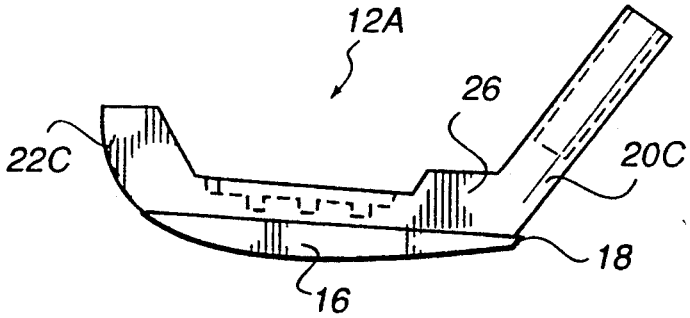
Fig. 10
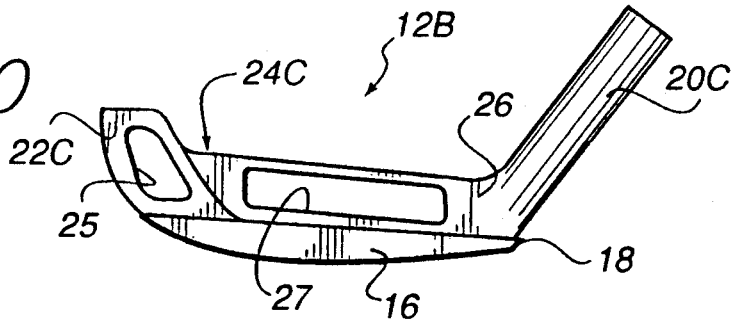
Fig. 11
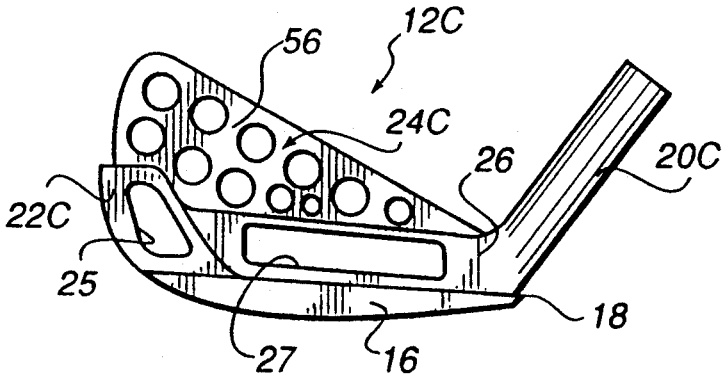

GOLF CLUB HEAD

BACKGROUND OF THE INVENTION

The present invention relates to golf clubs. Golf clubs include "woods" or drivers, and "irons", including fairway irons, wedges and putters. The present invention relates in particular to irons and to the heads of irons ("ironheads"), and is embodied in an ironhead fabricated by injection molding, and in the materials used in such an ironhead, including thermoplastic elastomers, which are injection molded about a metal core.

HISTORY DESCRIPTION OF THE RELEVANT TECHNOLOGY

A. Woodhead Design and Fabrication

As early as 1962, the golf industry introduced plastic woodheads, which were woodheads formed by injection molding ABS (acrylonitrile-butadienestyrene) plastic. These new clubs were not well received as premium clubs. Consequently, they were soon marketed primarily in beginners' sets and distributed largely through non-professional retail outlets. Golfing professionals as well as the golfing public in general developed the perception that plastic woods were strictly low end, low performance, inexpensive clubs.

Plastic golf clubs maintained this dubious distinction of being considered low-end golf equipment, despite their potential in at least certain areas for superior performance. For example, to my recollection, in the early 1960's, a small Australian golf equipment company, the PGF Golf Company, produced a line of plastic woods called LITTLE SLAMMERS, which married a very heavy brass soleplate to an inherently lightweight upper (outer) woodhead member molded from plastic. To my recollection, the total headweight of the LITTLE SLAMMER was about 225 grams, of which the top comprised about 100 grams and the soleplate about 25 grams. The resulting very low center of gravity of this composite clubhead imparted a high shot trajectory, making it relatively easy to get a ball up and out of difficult lies, and thus making the club suitable for use in tall grass and in the rough as well as in the fairway.

In the early 1970's, clubhead producers discovered that they could add small amounts of chopped graphite fibers to the ABS material used in the injection molding process, to form graphite-reinforced ABS woodheads. These new woodheads possessed somewhat greater strength than their plain ABS counterparts, due to a matrix assist generated by the fibers. However, the increase was relatively modest, because of limitations inherent to the processing technology available at the time and to the inability to effect a chemical bond between the ABS material and the graphite. The end result was encapsulation. Also, inadequate fiber flow control limited the achievable strength. That is, during injection molding, the plastic material, which was impregnated with ~⅛ inch long fibers, was shot through small diameter injector nozzles. The tendency of the fibers to cause jamming as the charge flowed from the injection nozzles through the inlet sprue, limited the proportion of fibers in the head material to ≦10 percent of the total weight of the plastic charge.

Actually, one of the primary "advantages" of the new graphite fiber-reinforced ABS plastic clubheads may have been perceptual, in that they were considered high technology, state-of-the art "graphite" clubs, rather than low cost, low tech "plastic" clubs. The lure of "graphite" in the head brought sufficient popularity to the design that injection molding finally became a viable golf clubhead manufacturing process, albeit one that was limited to the manufacture of woodheads.

In part because of the unresolved strength limitations imposed by the injection moldable material and fiber reinforcement, some manufacturers dedicated to the high end of the product market turned to compression molding. Using this process, the clubhead shell is formed by wrapping sheets of "prepreg" (epoxy impregnated) graphite fiber around a core, then heat and pressure are applied to mold the long fiber graphite sheets (the length of the fibers is about 1½ inches to 3 inches) about the core to form the shell. This approach permits the use of long fibers and thus provides relatively high strength plastic clubheads. However, the process suffers from several disadvantages. For example, first, compression molding is inherently a much more expensive process than injection molding. Second, the prepreg graphite sheets are very expensive, especially when compared to the chopped-graphite containing material used in the fabrication of woodheads by injection molding.

B. Design and Fabrication of Ironheads

Not surprisingly, the introduction of compression-molded, prepreg graphite woodheads gave rise to attempts to adapt compression molding technology to ironheads. However, the application of molding technology to irons confronts stringent design limitations and considerations that are not present in woods.

First, because of the relatively large size of the typical woodhead and the associated thick material section behind the impact area directly in line with the impact area of the club face (a typical woodhead has about about 2.5" to 3" of material behind the impact area), even relatively low impact rated materials can provide surface durability sufficient to withstand the impact associated with repeatedly striking golf balls. In contrast, traditional ironheads have a much thinner material section behind the face. For example, a typical metal ironhead has a blade thickness of about 9/64 inches (0.140 in.) to about ⅝ in. (0.625 in.) behind the impact area of the face. Thus, if moldable materials are to be used to produce an ironhead, a commensurately higher material impact rating is required for adequate iron durability and performance.

A second difficulty relates to achieving the desired final headweight. A full set of woods ranges in weight from about 200 grams to about 218 grams for the number 1 through number 5 woods. Although of smaller size than woods, irons are heavier, ranging from about 230 grams to about 286 grams for the number 1 iron to the number 9 iron, the relatively less lofted irons. The relatively more lofted pitching wedge and sand wedge weigh about 293 grams and about 305 grams, respectively. Achieving the final headweight is not a problem for woods because of their large size and method of manufacture. That is, woods, whether compression molded, injection molded or machined from wood, must be further machined to accept a soleplate and, often, a face insert striking face. Under the recessed cavity for the soleplate, holes are conveniently formed in the clubhead during the machining process. Lead or other weights can then be inserted into these holes to adjust the weight distribution and center of gravity before the soleplate or faceplate is attached to the wooden body.

Due to their completely different shape, irons typically can not use machining to achieve the final head wieght. This does not present a problem for metal ironheads, because the heavy specific weight of the metals used, such as stainless steel, provides the desired final weight by simply fabricating the clubhead to predetermined dimensions. It *is* a problem for plastic ironheads, however, because of the lighter weight of plastic materials such as elastomers, relative to the weight of solid metals.

The compression-molded prepreg composite technology has been adapted to overcome the above-discussed strength, weight and dimension restrictions inherent to the ironhead design. Before the very light weight graphite-reinforced plastic could be used, it was necessary to find a way to raise the weight to the required levels. For prepreg composite ironheads, this has been done by incorporating a steel inner core which is wrapped with prepreg graphite sheets and inserted into the mold for the compression mold process. The weight of the steel core is selected so that the combined weight of the core and the graphite sheets provided the desired final head weight.

To my knowledge, the steel inner cores used for compression molded graphite irons comprise a sole plate, a neck (hosel) and a partial, striking face support plate or a full, striking face support plate. The striking face support plate is necessary because, despite the increased strength provided by the long graphite fibers, the strength of the plastic striking face member alone would be insufficient to withstand the repeated impact stress on the neck associated with striking golf balls. Unfortunately, the weight of the full support plate raises the center of gravity and limits the ability of the designer to control the horizontal and vertical centers of gravity. Furthermore, as mentioned previously, compression molded fiber-impregnated ironheads have other, serious disadvantages: both the process of manufacture and the materials used are very expensive. Also, the materials used do not provide adequate durability and protection from the normal wear and tear associated with striking golf balls from turf over soil. Thus, it is highly desirable to be able to fabricate plastic ironheads using processes and materials which are less expensive.

Injection molding is a relatively inexpensive process which uses relatively inexpensive materials. However, several characteristics make it difficult to fabricate ironheads using injection molding.

First, it is necessary to have injection moldable materials which can satisfy the strength and wear requirements of ironheads, in particular, in the small-diameter, hollow, thin neck or hosel and, as discussed at length previously, in the relatively thin, face striking area.

Second, the injection molding process involves injecting a moldable material into a mold containing a metal inner core and requires complete "shooting" of the material over, around, and through the metal inner core to form the cover of the ironhead.

Third, the tolerances and reproducibility requirements for the metal inner cores used in plastic ironheads are stringent. Typically the inner core is formed by casting, such as investment casting. The soleplate, hosel and other sections of the inner core must be formed reproducibly by this process to the same size and orientation, to obtain the necessary loft and lie angles and so the inner core accurately fits into the injection mold cavity the same way each time. The accurate positioning requirement is particularly important for the hosel, because of the relatively low strength of the moldable materials and because the hollow hosel section of the inner core receives only a relatively thin overcoat of the molded material. The size and orientation of the hosel section must be the same for each inner core so that the small spacing around the hosel and between the hosel section and the surrounding mold wall(s) is of uniform dimension, and so that the coating formed by injection molding in that space has uniform thickness around the hosel and fully covers the hosel.

Reproducibly manufacturing the metal inner cores is difficult. During fabrication of the inner core by investment casting, as the cast metal cools, it shrinks and may move or pull inside the casting shell. As a result, it is necessary that the orientation of the hosel be corrected by bending to obtain the necessary fit within the mold and/or the necessary precise loft and lie angles.

It is my understanding that designers have been of the opinion that injection moldable materials are not strong enough to withstand repeated impact with golf balls, given the traditional form and the thickness (i.e., the relatively small dimensions) of the hitting area and the neck of ironheads, and because of the difficulty of repoducibly forming the thin covering of molded material over the hosel section of the inner core.

A fourth area (not to exhaust the difficulties), involves adhesion and/or tightness. Regarding adhesion, the charge material is injected into the mold at temperatures which frequently are 500° F. or greater, and is then cooled to about 350° F. to 400° F. before removal from the mold, then is quenched in cold water after removal. During this cooling phase, most injection moldable materials shrink in varying degrees ranging from slight to substantial, degrading the adhesion of the molded material to the inner core and creating gaps or spaces between the molded material and the metal inner core. Obtaining a tight, permanent bond is facilitated by sand blasting the inner surface of the inner core and coating the surface with adhesive such as SHUR LOCK adhesive.

I wish to emphasize that the difficulties in designing and manufacturing injection molded ironheads are in distinct contrast to the ready adaptation of injection molding technology to woodheads which occurred during the infancy of modern polymer technology. As alluded to previously, this successful early manufacture of injection molded woodheads is exemplified by the successful use of inferior plastic materials (inferior to later materials in terms of both strength and moldability) in the LITTLE SLAMMER fairway wood. However, woodheads, unlike ironheads, are relatively easy to mold. Also, woodheads are relatively thick behind the striking area of the face and this thicknesss compensated for the low impact strength of the plastic used in the LITTLE SEERS. The relatively much thinner top of ironheads would not compensate for low impact strength and so would not provide adequate durability. This statement is supported by our recent experiences with the use of LEXAN in woodheads and ironheads. LEXAN is a 10% glass-filled polycarbonate which has medium impact strength (better impact strength than the plastic used in the LITTLE SLAMMERS). Traditional-shaped *woodheads* made from LEXAN have sufficient durability and performance to compete with traditional wooden woodheads. In contrast, *ironheads* formed by injection molding LEXAN material over a non-face supported inner core fractured after striking golf balls only a very few times (≦35 hits).

The above-discussed difference in durability between plastic woodheads and plastic ironheads illustrates the different design and material priorities which apply to woodheads and ironheads. That is, for the material used in woodheads, the most important characteristic is a very low specific gravity, with impact strength and tensile strength being of much lesser importance. In contrast, the material used in ironheads must possess high flex modulus, high impact strength and high elongation, with low specific gravity being desirable of course, but of much lesser importance. In part because of such very different design and material priorities, the combination of performance and durability which has been achieved for injection molded woodheads has not translated into a successful injection molded ironhead. To date, to my knowledge the industry has not developed an injection molded ironhead which has the necessary combination of durability and performance. In fact, to my knowledge, the industry has not developed an injection molded ironhead at all.

SUMMARY OF THE INVENTION

In one aspect, my invention is embodied in an injection molded ironhead. In another aspect, the ironhead is an injection molded elastomeric material. This club head incorporates the above-summarized advantages of injection molded designs with additional advantages which include durability, and without the traditional disadvantages.

In a more specific preferred aspect, my ironhead is embodied in an ironhead for a golf club which comprises a relatively heavy inner core member and a relatively light weight elastomeric outer member formed over the inner core member by injection molding, with the outer member defining the striking face of the golf club head. The outer member is selected from thermoplastic elastomers. Preferably the thermoplastic elastomers are selected from glass-filled and non-glass-filled polycarbonates and glass-filled and non-glass-filled urethanes. Preferably, the inner core member is metal and is made by investment casting or by die casting using a suitable material. Presently, steel is the preferred material and the inner core is fabricated by investment casting. In general, however, other materials including other metals and alloys such as zinc and zinc alloys having the requisite weight and strength and castability can be used for the inner core. Preferably, at least about 70 percent of the weight of the ironhead is below the horizontal centerline of the clubhead.

The inner core member comprises a lower body member which forms a soleplate and an integral hosel. The outer member is formed over the lower body member and around the hosel by the injection molding process, thereby defining the striking face between the hosel and lower body member. In one embodiment, the lower body member extends upward partially the height of the upper member, forming a partial internal support plate for laterally supporting the striking face. Alternatively, the lower body does not extend substantially into the striking region. In another embodiment, the support plate extends substantially the height of the striking region, forming, in this latter embodiment, a so-called full face support plate.

A presently preferred embodiment incorporates a light weight, strike face support plate which provides support equivalent to a full support plate. In this embodiment, the inner core comprises a bar support member, preferably integral, which extends between the toe and the hosel for increasing the impact strength of the ironhead. This embodiment thus has light weight, with enhanced impact strength and durability. In addition, the bar support member increases the stability of the orientation of the hosel relative to the baseplate. This enhances the stability of the hosel orientation and the accuracy of the loft and lie angles. It also facilitates precisely positioning the inner core in the associated mold for injection molding the outer member.

The bar may be part of a frame which extends peripherally around the striking face.

In another aspect, the striking face has a designed impact point or region inside its peripheral boundary, and the inner core further comprises a triangular strike face support frame which extends upwardly from the lower body member and peripherally within the striking face.

In yet another aspect, my invention is embodied in an ironhead for a golf club, comprising: a relatively high specific gravity inner core comprising a hosel and an integral lower body member; and a relatively low specific gravity thermoplastic elastomeric upper body member formed over the lower body member and hosel by injection molding, with the upper body member defining the striking face of the golf club head.

BRIEF DESCRIPTION OF THE DRAWING

The above and other aspects of my invention are described below with respect to the drawing, in which:

FIGS. 7 and 8 are, respectively, bottom plan and top plan views of the inner core member depicted in FIGS. 4 through 6;

FIGS. 9 through 11 are front elevation views of alternative embodiments of inner core members.

DETAILED DESCRIPTION OF THE PREFERRED EMBODIMENTS

A. Preferred Ironhead Construction

Figure 3:
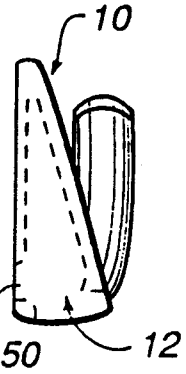
FIG. 3 is an elevation view of the ironhead of FIG. 1, taken from the toe end of the clubhead.
Figure 6:
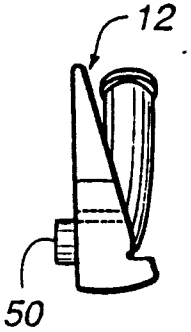
FIGS. 4, 5 and 6 are front, rear and toe side elevation views, respectively, of a preferred inner core member used in the ironhead of FIG. 1.
Figure 2:
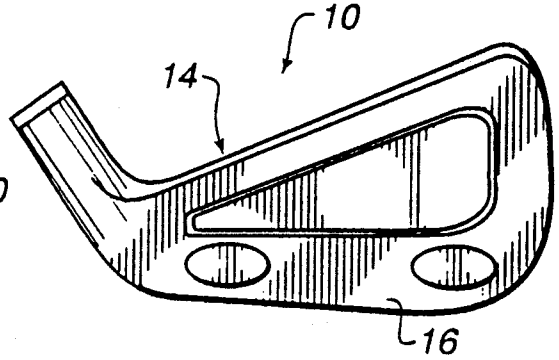
FIG. 2 is a rear elevation view of the ironhead of FIG. 1.
Figure 1:
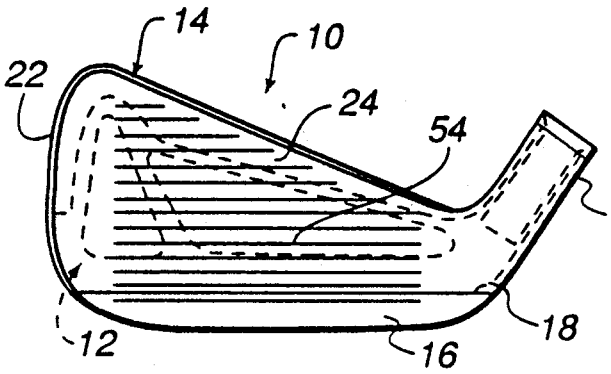
FIG. 1 is a front elevation view of an ironhead which is a presently preferred embodiment of my present invention.
Figure 5:
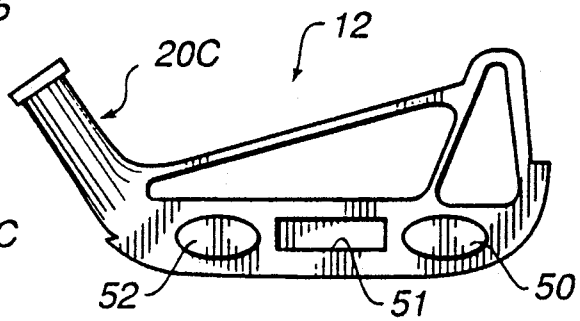

The preferred embodiment of my golf club head is best understood with reference to FIGS. 1–8. FIGS. 1–3 depict the preferred embodiment 10 of my as-molded "iron" golf clubhead or ironhead. FIGS. 4–8 depict the inner core 12 of the ironhead 10. This preferred embodiment of my ironhead comprises the inner core 12, FIGS. 4–8, preferably of relatively high specific gravity (heavy) metal such as stainless steel, and a relatively low specific gravity (light weight) cover member 14, preferably of thermoplastic elastomeric material, which is formed by an injection molding process over and around the inner core. Together the inner core 12 and the cover member 14 form sole plate 16 (the sole plate is part of the inner core), heel 18, hosel 20, toe 22 and striking face 24 of the clubhead 10.

The cover member (also called the upper member or outer member) 14 is unique, in part because it is formed from materials which are uniquely characterized by the combination of, first, possessing high flex and stress moduli, which provide high impact strength, yet, second, being readily fabricated onto the inner core configuration by injection molding. The advantages of this unique approach—the application of injection molding to form ironheads using readily injection-moldable materials having high flex modulus and high stress modulus and the resulting high impact ratings—is reflected in the design of the inner core 12.

The useful materials, which possess the above-described combination of moldability and physical characteristics, are thermoplastic elastomers, including non-glass-filled thermoplastic urethanes and polycarbonates, glass-filled thermoplastic polycarbonates, and, preferably, glass-filled thermoplastic urethanes. Product number BFG 61083 available from B. F. Goodrich Co. of Akron, Ohio under the trademark ESTALOC is presently the preferred material. This 40% glass-filled thermoplastic urethane material has excellent injection moldability, high strength and a very high flex modulus of about $1.45\times10^6$ lbs/in$^2$ (1.45 million pounds per square inch). Alternative ESTALOC glass-filled thermoplastic urethanes include product number BFG 61103, which is 50% glass-filled and has a flex modulus of $1.89\times10^6$ lbs/in$^2$, and product number BFG 61080, which is 40% glass-filled and has a flex modulus of about $1.15\times10^6$ lbs/in$^2$.

The Isod impact ratings for these glass-filled urethane materials, using the notched and unnotched impact tests, are (in ft.lbs./in.) 4.1 (notched) and 16.2 (unnotched) for the 61083, 3.9 and 14.4 for the 61003, and 5.0 and 15.4 for the 61080. The flex moduli are substantially higher than those of even the glass-filled polycarbonates. The tensile moduli (similar to the stress moduli) in million pounds per square inch are $1.55\times10^6$ lbs/in$^2$ for the 61083, $2.03\times10^6$ lbs/in$^2$ for the 61103, and $1.18\times10^6$ lbs/in$^2$ for the 61080.

Referring in particular to FIGS. 4–8, the inner core 12 is an integral (one piece) construction comprising the sole plate 16, a hosel member 20C, a toe member 22C and a striking face support member 24C having a preferred impact point or region at the vertical center of gravity 54 of the clubhead 10. (The suffix C is used to identify those inner core components which have corresponding or overlying components in the cover member 14 and/or in the completed clubhead 10.) As described in detail below, the inner core 12 has the effective strength and stability of a full face support plate, with little or no increase in weight relative to an embodiment which does not have a support plate. This is achieved by adding/incorporating a small bar 32 between the hosel and the toe of the inner core. The weight of the bar can be largely offset by the large hole 25 in the toe.

Figure 4:
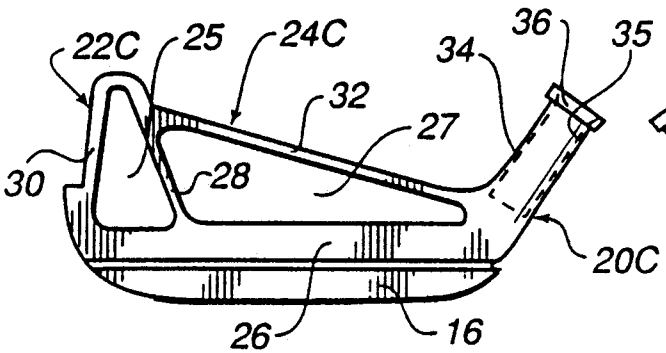
Figure 12:
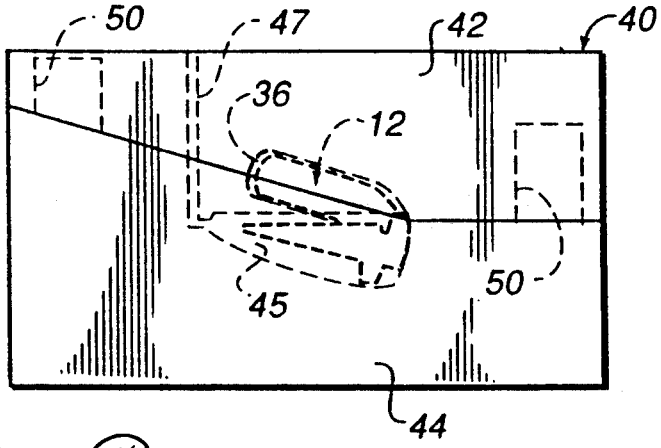
FIGS. 12 through 14 depict an injection mold used to form the outer cover of my ironhead.
Figure 13:
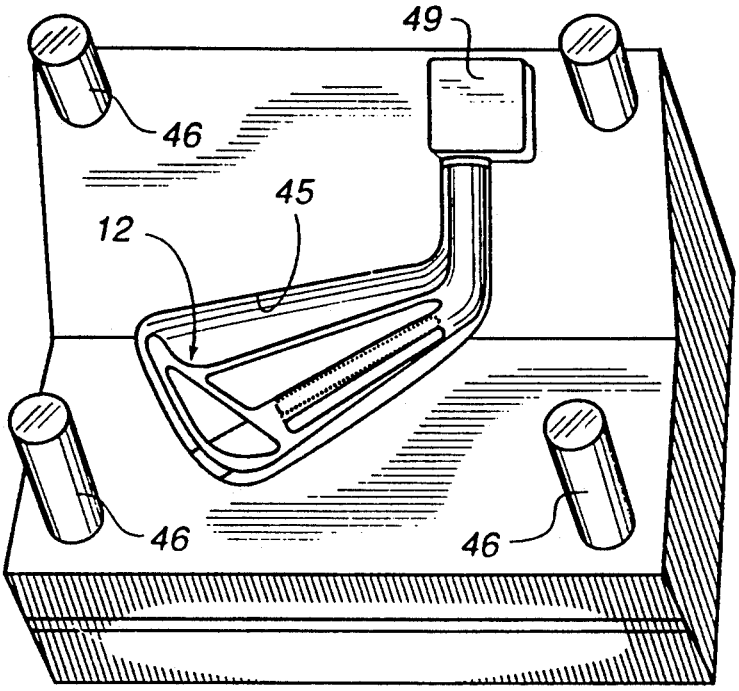
Figure 14:
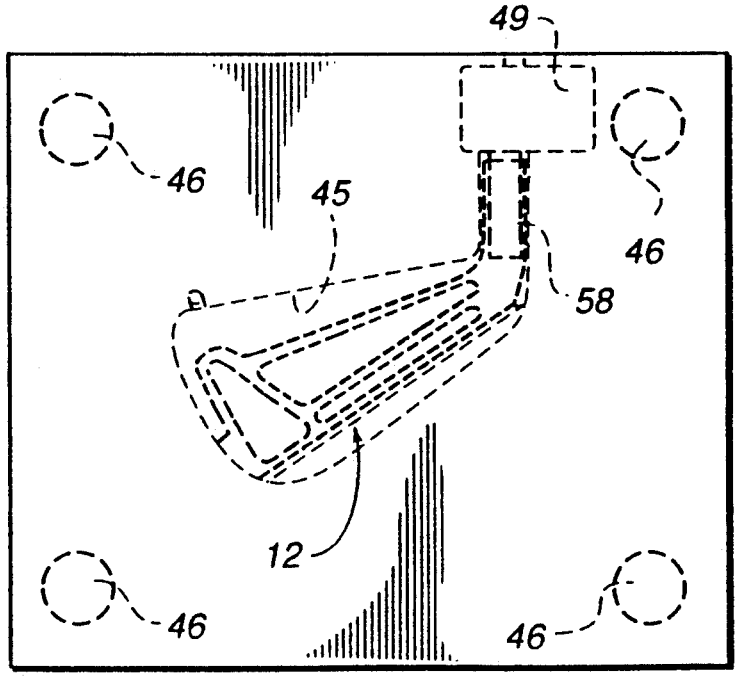

Referring primarily to FIG. 4, the hosel section 20C comprises a cylinder 34 which extends upward from frame member 26 traditionally at an angle of about 56° to 65° relative to the frame. The cylinder 34 has a collar 36 at the outer end and has an axial bore 35 for receiving the shaft (not shown) of the golf club. The integrally formed toe section 22C and support face section 24C comprise a plate-like member having two holes, one, 25, in the toe section and the second, 27, in the support face section. The toe section 22C is defined by a peripheral triangular array of bars or frame members 26, 28 and 30 surrounding the hole 25. The support face section 24C is defined by the peripheral triangular array of bars or frame members 26, 28 and 32 which surround the hole 27. The inherent structural rigidity of triangular frames and of the framework of two interconnected/merged triangles provide rigid support peripherally about the designed impact point 54, for increasing the impact strength of the ironhead and providing distributed weight about the periphery of the striking face and around the designed impact point. Also, the frame structure allows the use of large, weight reducing holes 25, 27. This light weight, strike face support plate 24C provides the support equivalent to a full support plate, with the weight equivalent to a partial support plate or no support plate.

Also, the bar support member 32, which extends between the toe and the hosel, increases the impact strength of the ironhead and provides stable orientation of the hosel relative to the frame. In short, this embodiment has light weight similar to the embodiment without the face plate, but with enhanced impact strength and durability and with stable orientation of the hosel relative to the baseplate, which provides stable loft and lie and facilitates precisely positioning the inner core in the associated mold for injection molding the outer member.

Inner core 12 includes cavity 51 for receiving a weight (not shown). This enables a single universal inner core 12 to be used in finished ironheads of different weights. For example, manufacturing the clubhead 10 with or without the weight provides finished clubs of normal swingweight using standard weight steel shafts, very light weight graphite shafts or super light weight metal alloy shafts. Also, back reliefs (protruding metal masses) 50 and 52 are incorporated. These increase the toe and heel perimeter weight. As a consequence, the moment of inertia of the ironhead 12 is lowered and the clubhead is thus more stable, with less vibration, when a ball is struck off the center of gravity.

B. Alternative Ironhead Designs

FIGS. 9 through 11 depict alternatives to the preferred ironhead design shown in FIGS. 4 through 8.

FIG. 9 depicts an alternative embodiment 12A of the inner core, what I term a "partial" frame construction. In this version, the central frame member 26 is of relatively short height: it extends upward only a small portion of the height of the striking face 24C.

The ironhead 12B depicted in FIG. 10 is similar to ironhead 12A, FIG. 9, except that the design 12A includes cut-outs 25 and 27 in the lower frame 26 and in the toe member for decreasing weight.

Ironhead 12C, FIG. 11, includes a lower frame member 26 that is the same as that of the ironhead 22B, FIG. 10, and also includes an integral perforated striking face support plate 56 which provides lateral support for the striking face member 24C.

C. Injection Mold and Process

Mold Structure

FIGS. 12–15 depict a presently preferred mold 40 for forming the outer cover 14. As shown in the end view of FIG. 12, the mold 40 comprises separable upper and lower sections 42 and 44. Referring also to the FIG. 13 perspective view as well as to FIG. 12, the lower section 44 includes four locating pins 46-46 and the upper section includes four mating holes 50-50 for accurately mounting the top section on the bottom section. The upper and lower sections define a cavity 45 therebetween in which the inner core 12 is positioned. An injection port 47, FIG. 12, connects to the mold cavity 45 for feeding a charge of melted material into the cavity. Enlarged upper hosel section 49 of the cavity 45 houses a pin or cylinder 58 shown in phantom in FIG. 14, into which the inner core hosel sectopm 34 is mounted via its bore 35, to precisely position the hosel in the cavity. In particular, this ensures the formation of a relatively thin coating of the desired thickness along the hosel section 34 to the end collar 36.

Process Example

In an exemplary injection molding process for forming the outer cover 14 on the inner core 12, the inner core is fabricated by investment casting, positioned in the mold cavity 45 and the upper and lower sections are closed. To form the outer cover, the mold charge—illustratively the glass-filled urethane material—is heated to an elevated temperature of about 500° F., then the molten charge is injected via the port 47 under pressure into the cavity 45 of the closed mold containing the inner core 12, and over and around the inner core 12 and through bores and holes such as 25 and 27, to completely cover the inner core and form the charge in the shape defined by the cavity 45. After the charge cools, the mold is opened and the resulting clubhead 10 is removed from the mold and the parting line is trimmed.

Typically, the members of the ESTALOC glass-filled urethane family have a melting temperature range of about 420° F. to 490° F. from the melting point to the onset of burning. For this range, the typical associated temperatures used during our injection molding process are 470° F. to 490° F. at the injection mold nozzle, 470° F. to 490° F. at the front end of the barrel, 450° F. to 470° F. at the middle of the barrel, and 430° F. to 460° F. at the feed end of the barrel. A screw speed of less than 100 rpm and injection speed of 1 to 3 inches per second are used to provide injection pressure of 500 to 1000 psi, with holding pressure of 200 to 500 psi, and mold back pressure of 25 to 100 psi. A water jacket (not shown) is used to cool the mold to 100° F. to 140° F. during the injection molding process. The in-mold cooling time is 20 to 60 sec.

Summary of Certain Advantages

Similar to compression molded ironheads, my invention used materials of very different density to provide a clubhead having a substantially lower center of gravity than metal ironheads and with a much higher percentage of weight in the lower half of the ironhead. In contrast to compression molding, my invention uses injection molding, which is a less expensive process than compression molding, and uses materials which are less expensive than those used for compression molding, and provides an ironhead construction having a light weight face support plate. Furthermore, the materials used in forming the outer striking surface of my ironhead do not require protective coatings to prevent delamination, degradation, chipping or pitting of the surface finish.

The heavy lower frame member and the heavy sole plate 16 provide a very low center of gravity, which enhances the trajectory for a given loft angle of the striking face 24. Also, by lowering the center of gravity of the clubhead 10 relative to that of the golf ball, the clubhead is made more forgiving of swing errors which would otherwise decrease trajectory. In fact, the heavy lower body member and sole plate provide a *very* low vertical center of gravity, characterized by at least 70 percent of the weight of the clubhead being below the horizontal centerline of the clubhead for the given dimensions and materials.

As a consequence of the relatively small size and weight of the central section of the frame 26 between the hosel 20 and the toe plate 22, and of the hosel itself, the weight of the club head can be distributed along the length of the clubhead from heel end 18 to toe end 22 and/or distributed around the periphery of the striking face 24, etc. The decreased size and weight of the hosel also decreases the bias of the horizontal center of gravity toward the heel and makes it easier to position the center of gravity at the designated ball impact point (typically, the dimensional center of the clubhead). In my preferred embodiment 10, the toe member 22 offsets the weight of the hosel 20 and positions the center of gravity precisely on the designed impact point 54 of the clubhead. Positioning the center of gravity to coincide with the impact point both (1) maximizes the energy transfer to the ball, thereby providing maximum distance and loft, and (2) decreases sliding of the ball across the clubface toward the center of gravity and the resultant misdirectional side spin such as slice spin or hook spin.

In short, my composition ironhead of uniquely configured relatively high specific gravity (heavy), inner core and injection-molded, uniquely configured, high strength, relatively low specific gravity (light weight) outer shell member petits wide latitude in tailoring the position of the centers of gravity and the weight distribution of the clubhead, and possesses other desirable characteristics such as low cost and surface and cosmetic stability.

Based upon the above disclosure of preferred and alternative embodiments of my invention, those of usual skill in the art will readily derive alternatives and implement modifications which are equivalent to my invention and within the scope of the claims of this patent document.

I claim:

1. An ironhead for a golf club, comprising: a relatively heavy inner core member and a relatively light weight outer member of material selected from thermoplastic elastomer and engineered plastic formed over the inner core member by injection molding; wherein the inner core member comprises a lower body member which forms a soleplate, an integral toe member and an integral hosel; the toe member and the hosel extending upwardly from the lower body member; wherein the outer member is formed over the lower body member and around the hosel, thereby defining a striking face between the hosel and the lower body member; and wherein the inner core comprises a bar spaced upwardly from the lower body member and extending from the toe member to the hosel.

2. The ironhead of claim 1, wherein the material of the outer member is selected from glass-filled thermoplastic urethane and glass-filled thermoplastic polycarbonate.

3. The ironhead of claim 1, wherein the inner core member is metal.

4. The ironhead of claim 1, wherein the inner core is steel.

5. An ironhead for a golf club, comprising: a relatively heavy inner core member and a relatively light weight outer member of material selected from thermoplastic elastomer and engineered plastic formed over the inner core member by injection molding; wherein the inner core member comprises a lower body member which forms a soleplate, an integral toe member and an integral hosel; the toe member and the hosel extending upwardly from the lower body member; wherein the outer member is formed over the lower body member and around the hosel, thereby defining a striking face between the hosel and the lower body member; and wherein the striking face has a designed impact point inside its peripheral boundary, and wherein the inner core member further comprises an integral frame member which extends between the toe member and the hosel and peripherally within the striking face circumscribing said impact point for increasing the impact strength of the ironhead and providing distributed weight about the periphery of the striking face removed from said impact point.

6. The ironhead of claim 5, wherein the material of the outer member is selected from glass-filled thermoplastic urethane and glass-filled thermoplastic polycarbonate.

7. The ironhead of claim 5, wherein the inner core member is metal.

8. The ironhead of claim 5, wherein the inner core member is steel.

9. An ironhead for a golf club, comprising: a relatively high specific gravity metal inner core comprising a hosel and an integral lower body member; and a relatively low specific gravity upper body member of thermoplastic elastomer, formed over the lower body member and hosel by injection molding, the upper body member defining the striking face of the golf club head; and wherein the inner core comprises a toe member extending upwardly from the lower body member and a bar spaced upwardly from the soleplate and extending from the toe member to the hosel.

10. The ironhead of claim 9, wherein the material of the outer member is selected from glass-filled thermoplastic urethane and glass-filled thermoplastic polycarbonate.

11. The ironhead of claim 9, wherein the inner core is steel.

12. An ironhead for a golf club, comprising: a relatively heavy inner core member and a relatively light weight outer member of material selected from thermoplastic elastomer and engineered plastic formed over the inner core member by injection molding; and wherein the inner core includes a toe section and a support face section, each section comprising a triangular array of frame members surrounding a hole filled with the selected material, the sections together having the form of two interconnected merged triangles and the support face section providing rigid support peripherally around a ball impact point in the selected material within the hole.

13. The ironhead of claim 12, wherein the material of the outer member is selected from glass-filled thermoplastic urethane and glass-filled thermoplastic polycarbonate.

14. The ironhead of claim 12, wherein the inner core member is metal.

15. The ironhead of claim 12, wherein the inner core is steel.

16. An ironhead for a golf club, comprising: a relatively high specific gravity metal inner core comprising a hosel and an integral lower body member; and a relatively low specific gravity upper body member of thermoplastic elastomer, formed over the lower body member and hosel by injection molding, the upper body member defining the striking face of the golf club head; and wherein the inner core includes a toe section and a support face section, each section comprising a triangular array of frame members surrounding a hole filled with the selected material, the sections together having the form of two interconnected merged triangles and the support face section providing rigid support peripherally around a ball impact point in the selected material within the hole.

17. The ironhead of claim 16, wherein the material of the outer member is selected from glass-filled thermoplastic urethane and glass-filled thermoplastic polycarbonate.

18. The ironhead of claim 16, wherein the inner core is steel.

* * * * *